United States Patent [19]

Lehman

[11] 4,445,296

[45] May 1, 1984

[54] SPRING POWERED SAUCER WITH LAUNCHING TAB AND PLATFORM

[76] Inventor: James A. Lehman, 59 Reid Ter. (Apt. 14), Fond du Lac, Wis. 54935

[21] Appl. No.: 374,007

[22] Filed: May 3, 1982

[51] Int. Cl.[3] ..... A63H 27/00

[52] U.S. Cl. ..... 46/74 D; 46/81

[58] Field of Search ..... 46/74 D, 75, 81, 74 R, 46/74 B; 273/108, 119 R, 126 R, 128 R, 424, 425, 427, 428, 317, 327, 337

[56] References Cited

U.S. PATENT DOCUMENTS 2,594,527 4/1952 Wechsler ..... 46/81 X
2,690,339 9/1954 Hall ..... 46/74 D X
2,953,378 9/1960 La Veigne, Jr. ..... 273/425 X
3,148,478 9/1964 Miller ..... 46/202 X
3,959,915 6/1976 Kettlestrings ..... 46/74 D

FOREIGN PATENT DOCUMENTS 467331 12/1951 Italy ..... 46/74 D

*Primary Examiner*—Mickey Yu
*Attorney, Agent, or Firm*—Isaksen, Lathrop, Esch, Hart & Clark

[57] ABSTRACT

This invention relates to a spring operated flying saucer toy wherein a spring located within the saucer is compressed by a hand held rod which, when released from the saucer, will propel the toy in a forward direction.

6 Claims, 9 Drawing Figures

SPRING POWERED SAUCER WITH LAUNCHING TAB AND PLATFORM

BACKGROUND OF THE INVENTION

The invention is a toy flying saucer which is a modification and an improvement upon a finger flicker saucer with spring powered tab developed by the inventor and for which a patent is pending having Ser. No. 328,365 filed Dec. 7, 1981. That application related to a flying saucer was an improvement upon a Finger Flicker Flying Saucer also developed by the inventor a U.S. Pat. No. 4,261,135 was granted. The finger flicker saucer with spring powered tab is very similar to the present invention but certain problems inherent in compressing the spring with the index finger, and in aiming the saucer were discovered and resolved by the present invention. Aiming the finger flicker saucer with spring powered tab is a problem inasmuch as the line of flight must be imagined, and then accomplished through a series of movements involving the index finger, thumb, and arm.

SUMMARY OF THE INVENTION

The saucer of the present invention utilizes a novel compression rod or rod and platform which the finger flicker saucer with spring powered tab did not have. With the spring powered saucer with compression rod a portion of the rod is inserted into the saucers lip through an opening located on the exterior of the lip with the result that a line of sight is provided by the remaining portion of the compression rod. The compression rod serves as a guide for launching inasmuch as the saucer will fly in the direction that the length of the rod is pointing. It should be noted that the spring is positioned perpendicular to the radius of the saucer and as such the thrust imparted helps to produce a spin which further facilitates flight.

These and other features and objects of the invention will be apparent to those familiar with this art from the following specification when taken into conjunction with the accompanying drawings.

DETAILED DESCRIPTION OF THE INVENTION

Figure 1:
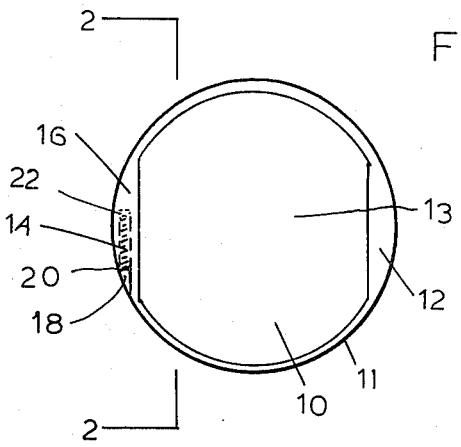
FIG. 1 is an underside view of the saucer.

Referring to FIG. 1. a flying saucer toy 10, is shown which is typical in configuration to existing toy flying saucers, having an air foil curvilinear depending lip 11 and a central body portion 13. In this embodiment the exterior of the lip 11 has a chamber opening 18 which allows a compression rod (similar to that shown in FIG. 3) to enter into the spring chamber 22 located in the spring housing 16 and to thereby compress spring 14. Said rod is then held in place by contact with the spring housing opening flange 20 located at the front of the spring chamber. A counter weight 12 is molded into the saucer opposite the spring housing to balance the saucer in flight.

Figure 2:
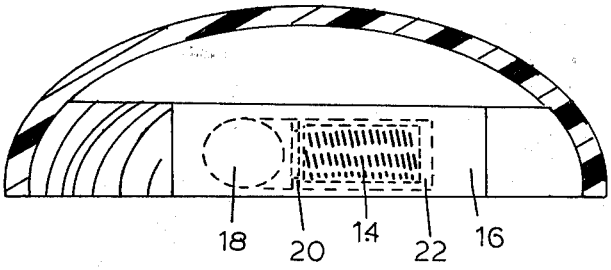
FIG. 2 is a magnified cross section of FIG. 1. taken along lines 2—2 showing the spring, the spring chamber, and the spring chamber opening.

FIG. 2 shows the spring 14, the spring chamber 22, the spring housing opening 18, and the spring housing opening flange 20 as they are arranged in the spring housing 16.

Figure 3:
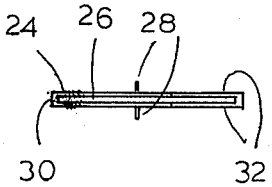
FIG. 3 is a top view of the compression rod with latches.
Figure 4:
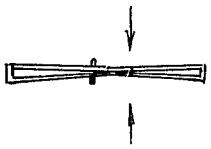
FIG. 4 is a view of the rod from the top showing the latches in the release position, obtained by squeezing the rod along its length.

FIG. 3 shows the compression rod. As can be seen the rod 24 has a core or hollow 26 and latches 28. The latches 28 are positioned on each side of the rod's length which are drawn in when the rod is squeezed at its middle FIG. 4 illustrates the rod 24 when it is squeezed as described above. The rod also has blunt nose 30 and finger pads 32 opposite the nose.

To launch the saucer, the rod 24 is inserted into the spring chamber 22 and squeezed behind the latches 28 to allow the latches 28 to pass the flange 20 at the opening of the spring chamber. Once inside the spring chamber 22 the rod's nose 30 compresses the spring 14 until near maximum compression is achieved. At that point the pressure along the sides of the rod is released allowing the rod latches 28 to lock against the inside surface of the flange 20 and to secure the rod to the saucer 10. When actual launching is desired the user then aims the rod in the direction he wishes the saucer to fly in and presses the sides of the rod again so as to allow the latches to withdraw from the saucer. The saucer is thereby propelled into flight by the release of the compression built up in the spring.

Figure 5:
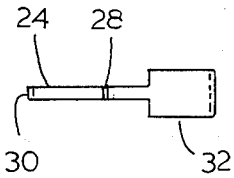
FIG. 5 is a side view of the rod.

FIG. 5 shows the rod 24 from one from the side and emphasizes the nose 30, the latch 28, and the finger pad 32 on that side.

Figure 6:
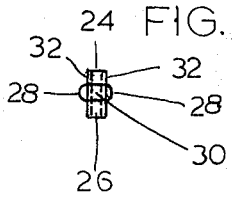
FIG. 6 is an end view of the rod.

FIG. 6 shows the rod 24 from the front, and emphasizes the nose 30, the latches 28, the finger pads 32, and the core or hollow 26 as seen from that view.

Figure 7:
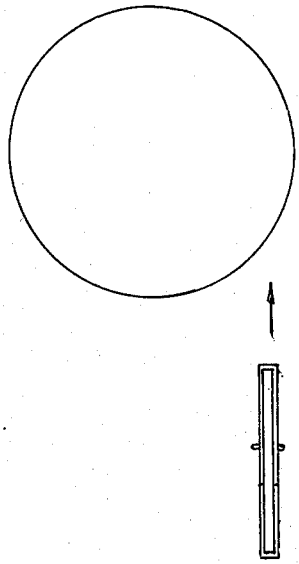
FIG. 7 is a top view of the rod and saucer seen just after launching.

FIG. 7 shows the position of the saucer and the rod just after flight has been accomplished.

Figure 8:
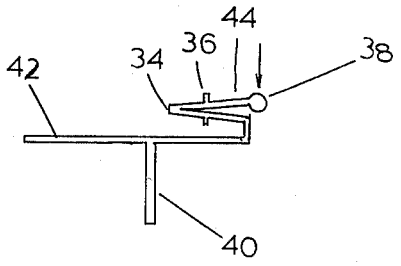
FIG. 8 is a side view of the rod and platform complex.
Figure 9:
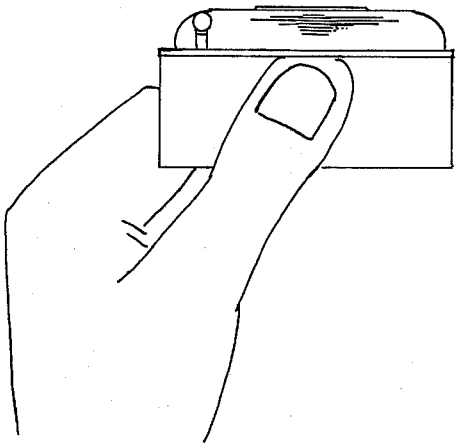
FIG. 9 is an end view of the rod and platform complex showing the saucer while locked in and being aimed.

FIGS. 8 and 9 show an alternative to the preferred embodiment described above. In the alternative embodiment, a launching platform 42 is integrated with a compression rod 44. The compression rod 44 differs slightly in configuration from the cored rod 24 shown in FIGS. 3–7 but functions essentially the same way. The rod nose 34 and latches 36 illustrated in FIG. 8 interact with the saucer in exactly the same manner as do the analogous rod parts illustrated in FIGS. 4–7. The difference between the two embodiments is that the latches 36 are positioned vertical to the base of the saucer in the alternative embodiment of FIG. 8; the rod latches 28 are positioned parallel to the base of the saucer in the embodiment shown in FIGS. 1–7, and of course, the rod is independent of a platform in the preferred embodiment of FIGS. 1–7. To lock or release the rod of the alternative embodiment after it has been positioned in the saucer, ball 38 is compressed while the platform grip member 40 is held, with the thumb and index finger.

FIG. 9. shows the saucer locked to the rod and positioned on the platform.

The saucer toy may be constructed of any material suitable for the purpose, such as but not limited to various types of plastic. The same is true for the rod and platform. The spring generally would be made of spring steel, but other metals or even plastic may be used.

Many changes may be made in the details of the instant invention, in the methods and materials of fabrication, in the configuration and assemblage of the constituent elements, without departing from the spirit and scope of the appended claims, which changes are intended to be embraced therewithin.

Having thus described the invention, what is claimed as new and useful and desired to be secured by United States Letters Patent is:

1. A toy flying saucer, comprising:

a. a central body portion having a curvi-linear air foil configured depending lip positioned around the periphery of said body portion, the lip having a chamber positioned perpendicular to the radius of the saucer;

b. a spring positioned in said lip chamber perpendicular to the radius of the saucer;

c. a compression member to be held in the hand and to be associated with said saucer body to compress a spring, said member being separate from said body;

d. latching means secured to said member and engaging the wall of said body at the rear end thereof for holding said member partly within said body to compress said spring;

e. said latching means having a resilient part laying outside said body and extending freely toward said body to be operated by manual pressure applied thereto when said member is held in the hand to release said body to the action of said spring, to cause said body to withdraw from said member while the latter is held in the hand as aforesaid.

2. The toy flying saucer of claim 1, wherein said compression member is a rod adapted to enter said chamber to compress said spring therein and to serve as a guide for launching the saucer inasmuch as the saucer will fly in the direction that the length of the rod is pointed.

3. The toy flying saucer of claim 2 wherein said saucer body is provided with a counter weight opposite the chamber and spring.

4. The invention as defined in claim 1 wherein said saucer body is provided with a counter weight opposite the chamber and spring.

5. The invention as defined in claim 3 wherein said rod is secured to a platform to produce a launching pad for the saucer.

6. The toy flying saucer of claim 5 wherein said saucer body is provided with a counter weight opposite the chamber and spring.

* * * * *